United States Patent [19]

Roberson

[11] 4,097,724

[45] Jun. 27, 1978

[54] FUEL VENDING APPARATUS AND METHOD

[75] Inventor: Ronald E. Roberson, Ayden, N.C.

[73] Assignee: Quick Fill, Inc., Ayden, N.C.

[21] Appl. No.: 775,832

[22] Filed: Mar. 9, 1977

[51] Int. Cl.[2] ..... G06M 3/12

[52] U.S. Cl. ..... 235/92 FL; 235/92 FP; 235/92 R; 235/94 A; 222/76

[58] Field of Search ..... 235/92 FL, 92 FP, 92 PE, 235/92 J, 94 A, 94 R; 222/23-28, 14, 15, 2, 76; 340/168 A; 194/13

[56] References Cited

U.S. PATENT DOCUMENTS

| | | | |
|---|---|---|---|
| 3,662,157 | 5/1972 | Somers | 235/92 FL |
| 3,852,577 | 12/1974 | Moon et al. | 235/92 FL |
| 3,907,165 | 9/1975 | Carbone | 235/92 FL |
| 3,999,685 | 12/1976 | Greenwood | 235/92 FL |

*Primary Examiner*—Joseph M. Thesz

*Attorney, Agent, or Firm*—Bell, Seltzer, Park & Gibson

[57] ABSTRACT

An apparatus and method for vending liquid fuel of the type wherein an electrically driven pump is controllably energized in response to a counter adding a credit unit as electrically signalled by a money acceptor. The counter subtracts credit units in response to a primary dispensing switch which is operatively responsive to the dispensing of fuel. In accordance with the present invention, a fail-safe circuit is provided which is electrically connected with the counter, acceptor and primary switch and which is operable for selectively disabling the pump from delivering fuel. A secondary dispensing switch is provided which is operatively responsive to dispensing of fuel and which cooperates with the fail-safe circuit in monitoring the normal sequence of vending steps and responding to abnormality in such normal sequence of steps by precluding delivery of pumped fuel.

19 Claims, 3 Drawing Figures

Figures 1, 2:
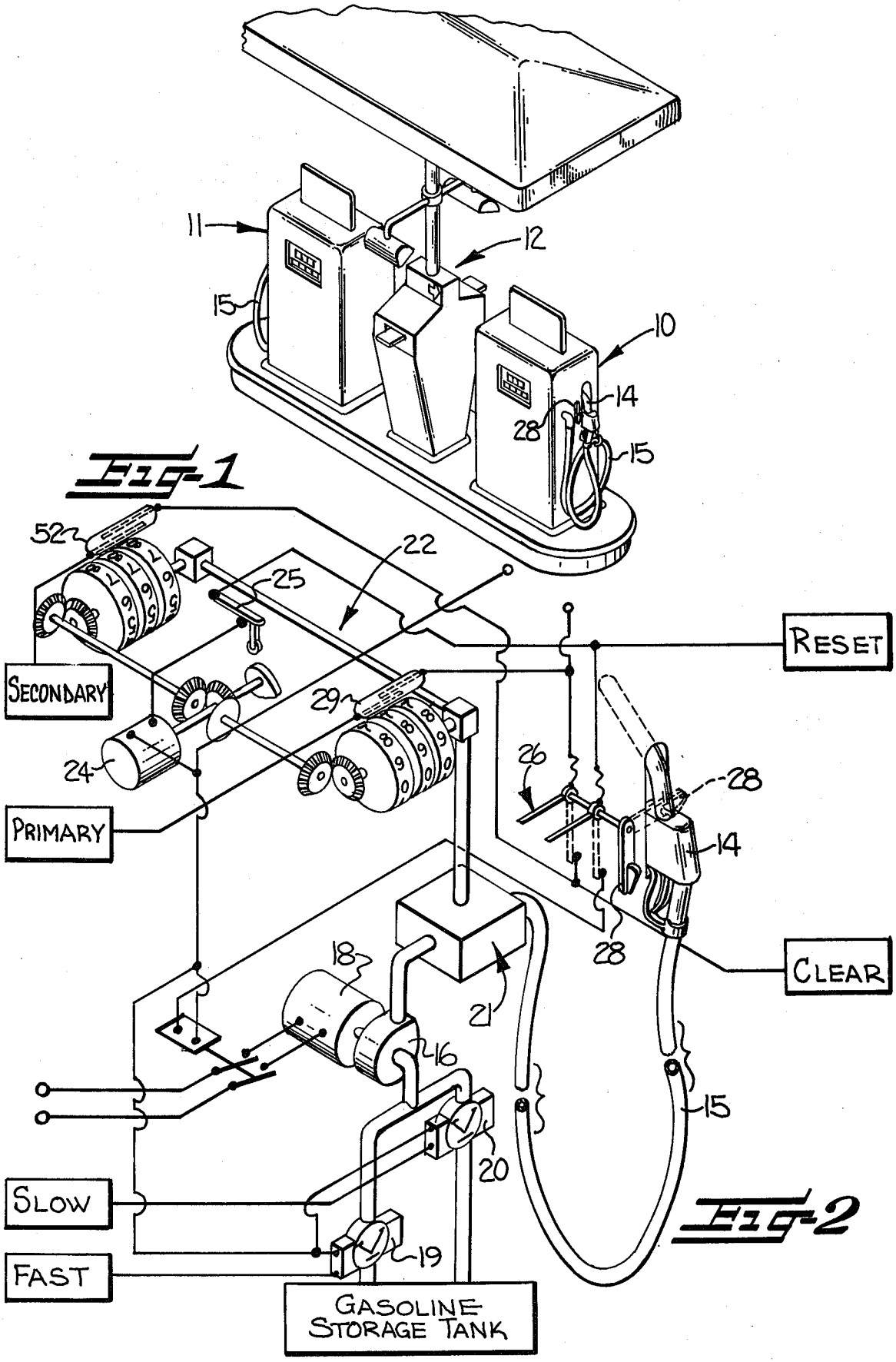

51B
51A
51
49B
49A
49
SECONDARY 48B
48A
48
42B
42A
42
T1
VALID MONEY
ACCEPT POWER
ACCEPTOR INHIBIT
30
31
32
34
36
37B
35
37A
37
39
40
46C
46B
46A
46
45C
45B
45A
45
50B
50A
50
SLOW
RESET
PRIMARY
41C
41B
41A
41
CLEAR
FAST
44B
44A
44

FUEL VENDING APPARATUS AND METHOD

Unattended fuel vending stations have grown in importance in the distribution and vending of liquid fuels, particularly in connection with sales of gasoline in less densely populated or rural areas. Such unattended stations are found to be substantially advantageous both for consumers of liquid fuel, such as gasoline, and for oil distributors. As will be appreciated, unattended service stations may be operated at any time of night or day by a customer desiring to purchase fuel and having the necessary currency. Further, such unattended stations do not, as indicated, require the presence of a service station employee.

As apparatus and methods for vending liquid fuel from unattended service stations have been developed, reliance has been placed upon money acceptors which electrically signal the insertion of currency or the like. Such a money acceptor typically signals a counter which adds and subtracts credit units. On a signal being received from the acceptor, the counter adds a credit unit and a substantially conventional fuel dispensing pump is enabled to deliver fuel. The customer then removes a fuel delivery nozzle from the substantially conventional pump, actuates a pump switch to reset the pump computer which indicates quantities of fuel delivered and calculates the value thereof, and delivers fuel into a vehicle or container. A primary dispensing switch is operated in response to the dispensing of fuel and electrically signals the counter to subtract credit units as indicated to be appropriate by the operation of the substantially conventional computer. Upon cancellation of all credit units, delivery of fuel is disabled, typically by de-energizing the electrical drive motor for the conventional pump. More specific disclosures of such apparatus and methods may be found by interested readers in pertinent prior patents.

Such fuel vending apparatus and methods, as employed heretofore, have suffered from certain difficulties and deficiencies. More particularly, prior electrical circuit arrangements have been subject to the welding together of contacts during an otherwise normal sequential operation of the electromechanical components of the apparatus. In the event of such contact welding, and particularly with respect to contacts controlling energization of the fuel pump, unauthorized delivery of fuel may occur. As a result of the circumstances of installation and use of fuel vending apparatus and methods of the type described, such unauthorized delivery of fuel can be economically disastrous for the fuel distributor supplying the unattended station. As will be appreciated, storage tanks from which such pumps draw may typically contain thousands of gallons of fuel, representing an inventory of substantial monetary value. Unauthorized and uncompensated delivery of such an inventory of fuel causes a substantial and immediate financial loss to the distributor.

Further, sophisticated thieves having knowledge of the construction and operation of pumps having primary dispensing switches have perfected deceptively simple ways of disabling such switches. Where reliance is placed only on such a single switch, the disabling of such switch permits unauthorized and uncompensated delivery of fuel to occur.

It is an object of the present invention to preclude unauthorized and uncompensated delivery of pumped fuel by an unattended service station in accordance with a method and by the use of an apparatus which guards against such dispensing by monitoring the normal sequence of vending steps and responding to abnormality in such normal sequence of steps by precluding delivery of pumped fuel. In realizing this object of the present invention, a fail-safe circuit means is electrically connected with conventional circuit components forming a portion of an apparatus for vending liquid fuel of the type described. Further, a secondary dispensing switch means is provided which is operatively responsive to the dispensing of fuel and which electrically signals the fail-safe circuit means. By cooperation of the fail-safe circuit means and the secondary switching means, the pump means is disabled from unauthorized and uncompensated delivery of fuel.

Yet a further object of the present invention is to interpose, in an apparatus for vending liquid fuel, a group of electromechanical relay means which are interconnected one with another and with operative elements of the vending apparatus in such a way as to monitor the normal sequence of vending steps and respond to abnormality by precluding delivery of pumped fuel. In accordance with this aspect of the present invention, relay means are provided for precluding delivery of pumped fuel and alternatively by de-energizing the entire vending apparatus or closing valves which control the flow of delivered fuel.

Figure 3:
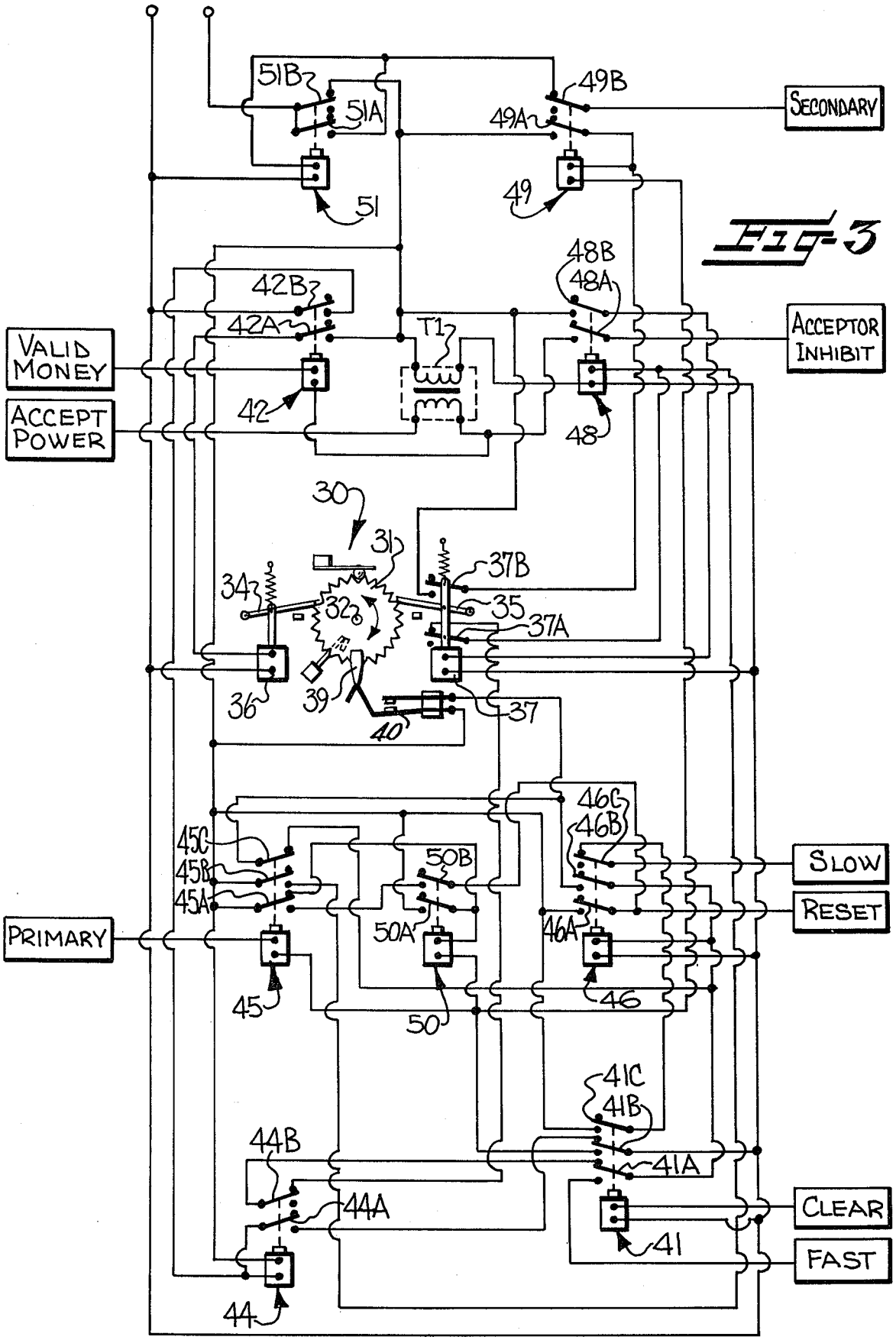

Some of the objects of the invention having been stated, other objects will appear as the description proceeds, when taken in connection with the accompanying drawings, in which FIG. 1 is a perspective view of an unattended service station embodying the present invention;

FIG. 2 is a schematic perspective view of a gasoline pump incorporating features of the present invention; and FIG. 3 is a schematic diagram of control circuit portions of the apparatus of FIG. 1, particularly illustrating the fail-safe circuit means of the present invention.

While the present invention will be described hereinafter with particular reference to the accompanying drawings, in which one embodiment of the present invention is shown, it is to be recognized at the outset of the following description that persons skilled in the applicable arts will be able to apply the principles of this invention to circuits which may differ in some specific details. Accordingly, the description which follows and the drawings to which that description relates are to be understood as a broad disclosure teaching the general utility of this invention, and are not to be taken as limiting upon the manner in which this invention may be used.

Referring now more particularly to the accompanying drawings, the environment of use of the present invention is illustrated generally in FIG. 1, where a pair of gasoline pumps, respectively generally indicated at 10, 11 are mounted on an island together with a central control console generally indicated at 12. The control console 12 contains money acceptor means (not shown in detail) of generally known type, with one acceptor being provided for each of the pumps 10, 11. The details of such an acceptor means can be determined by interested readers from prior patents or from manufacturers who offer such devices for sale to the vending industry generally. Acceptor means, as known to persons skilled in the applicable arts, contain elements which receive currency in the form of coins or bills, perform such tests as are necessary to determine the value and validity of the currency offered, and electrically signal the acceptance of currency. In the form preferred in accordance with the present invention, the money acceptor means receives and validates one dollar bills, electrically signalling each acceptance and validation of such a bill. In accordance with prior practice in vending liquid fuel from unattended service stations, the validation of a one dollar bill enables the corresponding gasoline pump to deliver a quantity of fuel corresponding to one dollar in value.

Each of the pumps 10, 11 includes an outlet nozzle and hose through which liquid fuel is delivered. Such nozzle 14 and hose 15 are visible at the pump 10 (FIG. 1) and accordingly the discussion which follows will be related particularly to that pump. As indicated in FIG. 2, the pump includes a pump means 16 for delivering fuel which is driven by an electrical motor 18 in accordance with conventional practice for gasoline vending pumps. A pair of flow rate controlling valves 19, 20 operatively communicate with the pump 16 in such a manner as to control delivery of gasoline through the hose 15 and nozzle 14. As will be described more fully hereinafter, the valves 19, 20 are electrically actuated solenoid valves, one of which functions to permit fuel delivery at a relatively fast rate of flow while the other functions to permit flow at a slower rate. While the valves 19, 20 are shown to be arranged in parallel flow relation one to another and in series with the pump 16, persons skilled in the arts of vending liquid fuel will appreciate that the functions described can be achieved by other specific arrangements of such valves.

Fuel delivered from the pump 16 is passed through a gauging device 21 of a type conventional in gasoline pumps and which drives a pump computer generally indicated at 22 for displaying to a customer the quantity of fuel delivered and the value of that fuel, computed by applying a preset cost per unit volume to the volumes delivered. In the form illustrated in FIG. 2, the computer 22 has been simplified in order to render description of this invention more readily understandable. Persons knowledgeable concerning the construction and operation of conventional gasoline dispensing pumps will be aware of the normal construction and operation of such a computer 22, which conventionally has number wheels displaying the value of fuel delivered on the two sides of the corresponding pump 10, as indicated in FIG. 2.

As is known to persons who have operated conventional gasoline pumps, an early step in the vending of fuel is to reset the computer 22 to a condition indicating delivery of no fuel and accumulation of no charges. In the pump according to the present invention, as in conventional pumps, this is accomplished by a reset motor 24 mechanically coupled to the number wheels of the computer 22. The reset motor 24 is additionally mechanically coupled to a reset stop switch 25 and enabling switch contacts 26, as is a manually actuable lever 28. In accordance with the construction and operation of the generally known Tokheim pump, the reset motor 24, reset stop switch 25, enabling switch 26 and lever 28 cooperate in a particular manner and sequence. While such cooperation will be described hereinafter and affects the particular construction and operation of the fail-safe circuit to be described, persons knowledgeable in the construction and operation of conventional pumps offered by other manufacturers will be able to readily adapt the present invention to other interlock arrangements. In a Tokheim pump, the mechanical coupling of the reset stop switch 25 with the motor 24 and lever 28 is such that the switch 25 closes upon the lever 28 being moved to the enable position (phantom lines in FIG. 2, or upwardly). Under such conditions, the motor 24 is energized to reset the computer and the enabling contacts 26 are held open until such time as the number wheels are zeroed. Upon the number wheels being zeroed, the reset stop switch 25 is opened to deenergize the motor 24 and the enabling contacts 26 are closed to permit pump operation. The enabling contacts 26 are subsequently opened upon downward movement of the lever 28 and are mechanically locked open until the computer 22 has again been zeroed. While the various mechanical interlocks have not been illustrated in FIG. 2, the construction and operation of such portions of the pump 10 will be clear to persons knowledgeable of such apparatus.

In common with other apparatus for vending liquid fuel in unattended service stations, provision is made in the pump 10 for responding to the dispensing of fuel by electrically signalling a counter to subtract credit units. This is accomplished, in the embodiment of the present invention, by a reed switch 29, postioned adjacent counting wheel portions of the computer 22 visible on one side of the pump 10. The reed switch 29 includes a pair of contact members sealed within an evacuated glass envelope, which contact members are drawn into engagement one with the other upon a magnet (not shown) mounted within one of the number wheels of the computer 22 passing closely adjacent the location of the reed switch 29. Such arrangements are known generally from prior patents, to which the interested reader is referred in the event that more detailed description is deemed necessary or appropriate. In the embodiment of the present invention, the primary dispensing switch means, in the form of the reed switch 29, is closed by a magnet so positioned as to come into operative relationship upon the tens counting number wheels of the computer 22 reaching the value of ninety cents. The contacts of the primary switch means are opened at all other positions of the tens counting wheels of the computer 22.

Referring now more particularly to FIG. 3, the apparatus of the present invention includes counter means for adding and subtracting credit units and as generally indicated at 30. In operating embodiments of the present invention, the counter means takes the form of an electromechanical stepping relay having a toothed member 31 mounted for movement about a central axis 32. Rotation of the toothed member 31 about the axis 32 is controlled by a pair of dog members 34, 35, one of which rotates the member 31 in a credit add direction (counterclockwise in FIG. 3) while the other rotates the member 31 in a credit subtract direction (clockwise in FIG. 3). The credit add dog member 34 is controlled by a credit add winding means 36, while the credit subtract dog member 35 is controlled by a credit subtract winding means 37. The member 31 includes a projection 39 by which a counter contact means 40 is controlled and is switched between an open condition (when the sum of credits added and subtracted is zero) and a closed condition (when the sum of credits added and subtracted is one or more). The credit subtract winding means 37 additionally controls the operation of two contact sets 37A, 37B as described more fully hereinafter.

The circuitry of FIG. 3 will additionally be noted as including counter enable relay means generally indicated at 41 having a winding electrically connected with one pole of the enabling switch 26 in the pump 10, so as to energize the winding of the counter enable relay means 41 as a customer desires to dispense liquid fuel. The counter enable relay means includes contact sets 41A, 41B and 41C controlled by energization of the winding of the relay means.

In accordance with the present invention, fail-safe circuit means are electrically connected with the counter means 30 and with the acceptor means 12 and with the primary switching means 29 for selectively disabling the pump from delivering fuel. The fail-safe circuit means preferably includes a plurality of electromechanical relays as more particularly illustrated in FIG. 3 and described more fully hereinafter. These relays include a credit in relay generally indicated at 42 having a winding connected with the acceptor 12 and which is energized in response to the electrical signalling of the acceptance of valid currency. The credit in relay 42 includes a pair of controlled contact sets 42A, 42B and the winding thereof is energized from a transformer generally indicated at T1 which provides the proper voltage for operation of the acceptor 12. An interlock relay is generally indicated at 44 and includes a pair of contact sets 44A and 44B.

First and second guard relays, respectively generally indicated at 45 and 46, are provided. Each of the guard relays 45, 46 has three corresponding sets of controlled contacts, 45A, 45B, 45C, 46A, 46B, 46C. A counter clear relay means is generally indicated at 48 and includes a winding, the energization of which controls a pair of contact sets 48A, 48B. A secondary inhibit relay means, generally indicated at 49, has a winding controlling a pair of contact sets 49A, 49B. A pump run relay means generally indicated at 50 has a pair of contact sets 50A, 50B controlled by the energization of the corresponding winding. Finally, a lockout relay means generally indicated at 51 has a pair of contact sets 51A, 51B controlled by energization of the corresponding winding.

As will be noted, energization of the winding of the counter enable relay means 41 is controlled by the enabling switch 26 in the pump 10 (FIG. 2), with the interconnection thereof being indicated in FIGS. 2 and 3 by an appropriate legend. Similar legends indicate the interconnections of the winding of the credit in relay means 42; the winding of the first guard relay means 45; a normally open contact set 41A of the counter enable relay means; a normally open contact set 46A of the second guard relay means; a normally closed contact set 46C of the second guard relay means 46; a normally open contact set 48A of the counter clear relay means 48; and a normally closed contact set 49B of the secondary inhibit relay means 49. The last mentioned contact set 49B of the secondary inhibit relay means 49 is interconnected with a secondary reed switch 52 (FIG. 2) generally similar to the reed switch 29 and positioned adjacent the number wheels of the computer 22 for similar actuation as described more fully hereinafter.

Referring now to the method of vending liquid fuel in accordance with the present invention, the acceptor 10 senses acceptance of money and electrically signals credit units in response thereto. Credit units are added by rotation of the member 31 of the counter means 30, which permits closure of the counter contact means 40 and thereby enables energization of the fuel pump drive motor 18 through a heavy duty relay 54, as described more fully hereinafter. As a customer pumps fuel, delivery thereof is sensed by the primary reed switch 29, which electrically signals credit units recorded on the number wheels of the computer 22. In response to signals from the primary reed switch means 29, credit units are subtracted by clockwise rotation of the member 31, eventually opening the counter contact means 40 and disabling energization of the fuel pump upon cancellation of all credit units.

In accordance with the present invention, such operation is guarded against improper dispensing of gasoline by the steps of monitoring the normal sequence of such vending and responding to abnormality in such normal sequence of steps by precluding delivery of pumped fuel. Such precluding of delivery of pumped fuel may occur either by de-energizing the vending circuitry including the pump drive motor 18 or by closing the fast and slow valve means 19, 20 even though energization of the pump drive motor 18 is permitted.

Referring now more particularly to a normal sequence of vending operations, a valid money signal from the validator energizes the winding of the credit in relay means 42, closing a normally open contact set 42A. Closure of the normally open contact set 42A energizes the credit add winding 36, rotating the movable member 31 counter clockwise to add one credit unit and permitting closing of the counter contact means 40. Another normally open contact set 42B of the credit in relay means 42 energizes the winding of the interlock relay means 44, which locks in through its own normally open contact set 44A and a normally closed contact set 41B of the clear relay means 41. A normally closed contact set 44B of the interlock relay means 44 is opened, to block energization of the counter clear relay means 48 and to prevent the counter 30 from clearing any credit carried.

The counter contact means 40, through a normally closed contact set 45C of the first guard relay means 45, energizes the winding of the second guard relay means 46 which then locks through its own normally open contact set 46B and the counter contact means 40. Another normally open contact set 46C electrically energizes the reset line to the pump 10, completing a circuit which will enable energization of the computer reset drive motor 24 in accordance with conventional pump operation as described above. Another normally closed contact set 46C opens, blocking energization of the slow valve means 20 in the pump 10.

After inserting appropriate currency into the acceptor 12, a customer may remove the nozzle 14 from the pump 10 and, by moving the lever 28, enable energization of the computer reset motor 24, which drives the number wheels of the computer to a zero condition and is then de-energized by opening of the reset switch 25. Upon completion of resetting as described above, a circuit is completed which energizes the winding of the counter enable relay means 41.

Upon energization of the winding of the counter enable relay means 41, normally closed contacts 41A thereof open and block energization of the winding of the counter clear relay 48. Associated normally open contacts 41A close, energizing the fast valve 19 and permitting fuel to be pumped by the pump 16 from a gasoline storage tank through the hose 15 to the nozzle 14 and a vehicle or the like into which fuel is to be dispensed. A normally open contact set 41B, on closing enables energization of the first guard relay means 45, the secondary inhibit relay means 49 and the pump run relay means 50. An associated normally closed contact set 41B removes energization from the winding of the interlock relay means 44. Another normally open contact set 41C enables energization of the slow valve 19 within the pump 10.

On de-energization of the winding of the interlock relay means 44, normally closed contacts 44B thereof enable energization of the counter clear relay means 48.

The winding of the pump run relay means 50 is energized through normally closed contacts 45A of the first guard relay means 45 and locks through its own normally open contacts 50A.

As the dispensing of fuel continues, the counting wheels of the computer 22 are positioned to indicate delivery of a quantity of fuel having the value of ninety cents. As the wheels move to such a position, a magnet carried by the tens wheel is positioned to close the contacts of the primary reed switch 29 which energizes the winding of the first guard relay means 45 through normally open contacts 41B of the counter enable relay means 41. On opening of a normally closed contact set 45A of the first guard relay, the pump run relay means 50 is left energized solely by reason of its holding contact 50A. The normally open contacts 45A on closing, feed the closed contacts 50B of the pump run relay means 50. The normally open contacts 45B, on closing, energize the winding of the counter clear relay means 48. A normally open contact set 48B thereof, when closed, energizes the credit subtract winding 37, rotating the movable member 31 of the counter means clockwise and (on cancellation of the last or a single credit unit) opening the counter contact means 40. By means of a normally open contact set 48A, the acceptor 12 is signalled that no currency should be accepted during the interval of time required for the pump 10 to dispense the final ten cents value of a credit unit. A normally open contact set 37B controlled by the credit subtract winding 37 energizes the winding of the secondary inhibit relay 49 during dispensing of the first credit unit. The secondary inhibit relay means 49 is locked in an energized condition by its own normally open contact set 49A and, by means of a normally closed contact set 49B, blocks energization of the winding of the lockout relay means 51 upon the closure of the secondary reed switch means 52.

The opening of the counter contact means 40 de-energizes the winding of the second guard relay means 46, thereby de-energizing the fast valve 19 and energizing the slow valve 20 through a contact set 41C. Even though the second guard relay means 46 has been de-energized, energization of the pump motor relay 54 and the pump drive motor 18 is maintained by reason of a circuit through contacts 50B of the pump run relay means 50 and contacts 45A of the first guard relay means 45.

With completion of vending of a credit unit, or fuel in a quantity having a value of one dollar, the tens wheel of the computer 22 is moved to a position at which the primary reed switch 20 is opened. Opening of the primary reed switch interrupts energization of the winding of the first guard relay means 45, upon which opening of a contact set 45A thereof de-energizes the pump drive motor 18 and the vending of a credit unit of fuel is concluded.

Persons familiar with the operation of such circuitry will be able to trace, from the above description of vending of a single credit, the vending of multiple credit units of fuel where successive bills are introduced into the acceptor 12. Accordingly, a full description of such a sequence of operation of the electromechanical relay means will not be here set forth.

Operation of somewhat similar prior systems has disclosed two principal causes of failure related to components in the pump 10. First, the primary reed switch means 29 may fail to properly operate or may be purposely damaged by a thief. Second, the customer actuated enabling switch 26 may fail to properly operate or may be improperly connected. In the instance of the first type of failure, the winding of the first guard relay means 45 is not properly energized, leading to failure of proper sequential energization of the counter clear relay means 48 and the credit subtract winding means 37. Failure of proper sequential energization of such windings will preclude energization of the winding of the secondary inhibit relay means 49, permitting an electrical signal from the secondary reed switch means 52 to energize the winding of the lockout relay means 51. Such a signal is passed on the occurrence of some event normally subsequent to turning of the number wheels to a ninety cents value, such as passage of the wheels to a dollar value. Upon energization of the lockout relay means 51, that relay locks in the energized position through one set of contacts 51A and interrupts the delivery of electrical current to the remainder of the system through another contact set 51B. The pump 10 cannot be restored to a normal operative condition by any action of a customer and requires the attention of a serviceman in order to permit re-energization of the components and restore the possibility of vending fuel. However, such failure of operation does not cancel from the counter means 30 any remaining credits which may have been added thereto prior to failure of the primary reed switch means 29.

In the event of failure of the customer operated enabling switch 26, the winding of the counter enable relay means 41 is never energized, precluding energization of the winding of the first guard relay means 45. While operation of the drive motor 18 for the pump may be permitted, neither of the fast and slow valves 19, 20 is energized and no fuel may be drawn from the storage tank by the pump 16 and delivered through the nozzle 14.

The fail-safe circuit means of the present invention further guards against failure by welding of a contact set either of the first and second guard relay means 45, 46. In the event of welding of the contacts of the first guard relay means 45, the second guard relay means 46 and pump run relay means 50 never energize. Consequentially, no fuel is delivered. In the event that the contacts of the second guard relay means 46 weld, fuel will be delivered until such time as the primary reed switch 29 closes, at which time both the slow and fast valves 19, 20 will close and no more fuel will be delivered.

Theft from the vending apparatus of this invention is made more difficult by the protective features pointed out above and by the separation of the primary and secondary dispensing switch means 29, 52. More particularly, the counter clear relay means 48 operates, on movement of the lever 28 to a pump off position, to cancel all outstanding credit on the counter means 30, by cyclically energizing the credit subtract winding 37 until the counter switch means 40 is opened and held open. Such operation precludes repetitive vending of less than ninety cent quantities which might otherwise occur. Further, the separation of the primary and secondary dispensing switches 29, 52 assures that hanging up or damage of one set of number wheels of the computer 22 will not preclude cancellation of credit.

One modified form of this invention replaces the single secondary switch 52 with a pair of switches wired in series and responsive to magnets carried by the tens wheel and the cents wheel so as to signal upon the number wheels turning to a ninety five cents value.

Another modified form of this invention dispenses with the secondary inhibit relay means 49 and connects a normally closed contact set (not shown) actuated by the credit subtract winding 37 in place of the normally closed contact set 49B. This modification enables the fail-safe circuitry to check for proper operation of the primary dispensing switch means 29 on each successive dollar value vended.

In the drawings and specification, there has been set forth a preferred embodiment of the invention, and although specific terms are employed, they are used in a generic and descriptive sense only and not for purposes of limitation.

That which is claimed is:

1. In apparatus for vending liquid fuel and having an electrically driven pump means for dispensing fuel, counter means for adding and subtracting credit units and electrically connected for controllably energizing said pump means, money acceptor means for signalling said counter means to add credit units, and a primary dispensing switch means operatively responsive to the dispensing of fuel for signalling said counter means to subtract credit units, the combination therewith of means for guarding against improper dispensing of gasoline and comprising fail-safe circuit means electrically connected with said counter means and said acceptor means and said primary switching means and operably for selectively disabling said pump means from delivering fuel, and secondary dispensing switch means operatively responsive to the dispensing of fuel for signalling said fail-safe means, said fail-safe means responding to signalling by said secondary switching means and abnormality in normal sequential operation of said counter means and said primary switching means by disabling fuel delivery.

2. Apparatus according to claim 1 wherein said fail-safe means comprises guard relay means electriclly connected for controlling energization of said pump means for de-energizing said pump means in the event of abnormality in the normal sequence of fuel delivery.

3. Apparatus according to claim 1 further having fast and slow electrical solenoid valve means each in flow controlling relation to said pump means for controlling the rate of flow of fuel delivery, and further wherein said fail-safe means comprises guard relay means electrically connected with said valve means for closing said valve means in the event of abnormality in the normal sequence of fuel delivery.

4. Apparatus according to claim 1 wherein said fail-safe means comprises lock-out relay means electrically connected for controlling energization of said counter means and said acceptor means and said primary switching means for de-energizing the same in the event of abnormality in the normal sequence of fuel delivery.

5. In apparatus for vending liquid fuel and having an electrically driven pump means for dispensing fuel, counter means for adding and subtracting credit units, counter contact means electrically connected for controllably energizing said pump means upon and while the sum of credit units added and subtracted is at least one, money acceptor means for electrically signalling said counter means to add credit units, and a primary dispensing switch means operatively responsive to the dispensing of fuel for electrically signalling said counter means to subtract credit units, the combination therewith of means for guarding against improper dispensing of gasoline and comprising fail-safe circuit means electrically connected with said counter contact means and said acceptor means and said primary switching means and operable for selectively disabling said pump means from delivering fuel, and secondary dispensing switch means operatively responsive to the dispensing of fuel for electrically signalling said fail-safe means, said fail-safe means responding to signalling by said secondary switching means and abnormality in sequential operation of said counter contact means and said primary switching means by disabling said pump means from delivering fuel.

6. Apparatus according to claim 5 wherein said fail-safe circuit means comprises counter clear means operative in response to abnormality in sequential operation of said apparatus for electrically signalling said counter means to subtract credit units.

7. Apparatus according to claim 5 wherein said fail-safe circuit means comprises first and second guard means interconnected one with another and operative in response to abnormality in sequentialy operation of said apparatus for precluding pumping of fuel.

8. Apparatus according to claim 7 wherein first guard means is electrically connected with and responsive to said primary dispensing switch means and is electrically connected with the controlling said pump means for controllably de-energizing said pump means in response to abnormality in sequential operation of said apparatus.

9. Apparatus according to claim 7 further having fast and slow electrical solenoid valve means each in flow controlling relation to said pump means for controlling the rate of flow of fuel delivery and further wherein said second guard means is electrically connected with said valve means for controllably de-energizing said valve means in response to abnormality in sequential operation of said apparatus.

10. Apparatus according to claim 5 wherein said apparatus has first and second sets of number wheels driven in response to dispensing of fuel and further wherein said primary dispensing switch means is operable in response to rotation of one of said sets of number wheels and said secondary dispensing switch means is operable in response to rotation of the other of said sets of number wheels.

11. Apparatus according to claim 5 wherein said counter means comprises stepper relay means including a movable member, credit add winding means operable for moving said member in a credit add direction, and credit subtract winding means operable for moving said member in a credit subtract direction, said member being operatively coupled to said counter contact means for opening the same upon the sum of credits added and subtracted being zero.

12. In a fuel vending apparatus having a money acceptor means for electrically signalling acceptance of credit units, a primary dispensing switch means for electrically signalling delivery of fuel having a credit unit value, and an electromechanical counter means for adding and subtracting credit units respectively signalled by said acceptor means and said primary dispensing switch means and for enabling fuel delivery upon and while the sum of credit units added and subtracted is at least one, the combination therewith of a secondary dispensing switch means for electrically signalling delivery of fuel, and a plurality of electromechanical relay means electrically connected one with another and with said counter means and said dispensing switch means for monitoring a normal sequence of fuel delivery steps thereof and for responding to abnormality in such normal sequence by disabling fuel delivery.

13. Apparatus according to claim 12 wherein said relay means comprise counter clear relay means operable in response to abnormality in such normal sequence for signalling said counter means to successively subtract credit units until the sum of credits added and subtracted is zero.

14. Apparatus according to claim 12 wherein said relay means comprises lock-out relay means operable in response to abnormality in such normal sequence for de-energizing all of said dispensing switch means and said counter means.

15. Apparatus according to claim 12 further having pump switch means operable upon readiness of said apparatus for delivery of fuel and further wherein said relay means comprises first and second guard relay means respectively electrically connected with said primary dispensing switch means and with said counter means for energization therefrom, and counter enable relay means electrically connected with said pump switch means for energization therefrom, said guard relay means and said counter enable relay means cooperating in response to abnormality in such normal sequence for precluding fuel delivery.

16. In a method of vending liquid fuel which normally includes the sequential steps electrical and mechanical of sensing acceptance of money and electrically signalling credit units in response thereto, adding credit units and enabling energization of a fuel pump in response to signalling of credit units, pumping fuel while sensing delivery thereof and electrically signalling credit units in response thereto, and subtracting credit units and disabling energization of the fuel pump upon cancellation of all credit units, an improvement which guards against improper dispensing of gasoline and comprises the steps of sequentially energizing and de-energizing a plurality of electrical relays interconnected in a fail-safe circuit, distinguishing with the relays the energization and de-energization thereof in a predetermined normal sequence from the energization and de-energization thereof in an abnormal sequence and thereby monitoring the normal sequence of vending steps, and responding to abnormality in such normal sequence of steps by precluding delivery of pumped fuel.

17. A method according to claim 16 wherein the precluding of delivery comprises de-energizing the fuel pump.

18. A method according to claim 16 wherein the precluding of delivery comprises closing valves controlling flow through the fuel pump.

19. A method according to claim 16 wherein the precluding of delivery comprises disabling the signalling of credit units and the adding and subtracting of credit units and the energization of the fuel pump.

* * * * *

UNITED STATES PATENT AND TRADEMARK OFFICE

CERTIFICATE OF CORRECTION

PATENT NO. : 4,097,724

DATED : June 27, 1978

INVENTOR(S) : Ronald E. Roberson

It is certified that error appears in the above-identified patent and that said Letters Patent are hereby corrected as shown below:

Column 6, Line 41 after the word "set" delete 46C and insert therefor - 46A -

Column 7, Line 58 after the word "switch" delete 20 and insert therefor - 29 -

Column 8, Line 46 after the word "set" insert - of -

Column 10, Line 28 after the word "wherein" insert - said -

Column 10, Line 31 after the word "with" delete the and insert therefor - and -

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*